United States Patent [19]

Turkia

[11] 4,011,701

[45] Mar. 15, 1977

[54] MODULAR HOME WALL CONSTRUCTION CORNER JOINT

[75] Inventor: Kalevi Matti Turkia, Williamsport, Pa.

[73] Assignee: Capital Housing, Inc., Avis, Pa.

[22] Filed: Mar. 29, 1976

[21] Appl. No.: 671,856

[52] U.S. Cl. ..... 52/275; 52/593; 52/583; 52/587

[51] Int. Cl.[2] ..... E04B 1/00; E04C 1/10

[58] Field of Search ..... 52/275, 612, 593, 127, 52/583, 227, 587, 585, 210, 347

[56] References Cited

UNITED STATES PATENTS

| | | | |
|---|---|---|---|
| 2,362,119 | 11/1944 | De Stefano | 52/612 |
| 3,353,314 | 11/1967 | Melcher | 52/593 |
| 3,466,821 | 9/1969 | O'Shaughnessy et al. | 52/593 |
| 3,473,277 | 10/1969 | Straight | 52/593 |

*Primary Examiner*—Price C. Faw, Jr.
*Assistant Examiner*—Robert C. Farber
*Attorney, Agent, or Firm*—Sughrue, Rothwell, Mion, Zinn & Macpeak

[57] ABSTRACT

Edge abutting inner and outer frame assemblies carry parallel strips of thermal insulation material within respective vertical and horizontal cavities with the strip seams at right angles to each other to eliminate cold spots. The respective end studs of right angle, end abutting vertical wall assemblies have inner and outer wall frames overlapping to form a stepped end assembly which nests and sandwiches an air barrier strip interposed between abutting end studs. Spaced lag screws or bolts fix end studs of one frame assembly to end studs of the other frame assembly at the stepped end assembly. The outer walls extend beyond the end studs of the outer frames of each wall assembly to form the exterior wall, corner joint, and thermal insulation material strips fill the cavity formed between the outer walls and the end studs of respective wall assemblies.

3 Claims, 5 Drawing Figures

MODULAR HOME WALL CONSTRUCTION CORNER JOINT

BACKGROUND OF THE INVENTION

1. Field of the Invention

This invention relates to modular home construction and more particularly to an improved double insulated wall assembly and the corner connection therebetween.

2. Description of the Prior Art

The high cost of building materials and labor costs have assured the success of the modular home and mobile home industry. Such homes can be constructed in modular fashion of prefabricated walls joined together at abutting ends, either on site or during factory construction. In the past, such wall construction, particularly at the corner joints has resulted in high heat loss due to the inability to maintain high thermal impedance in this area in the area of the vertical corner joint. At the same time, the necessity to join two preformed modular assemblies such as the wall assemblies or a wall to roof assembly, has resulted in leaks permitting the penetration of water, particularly when the buildings are subjected to torrential rains and the like after on-site construction.

Further, in the creation of the individual walls or wall assemblies themselves, prior to joining the same at the corners to other end walls, at their bottom edges to a base or foundation and at the top edges to a roof assembly, it has been difficult to insure effective thermal insulation between the inner and outer walls of each wall assembly or unit. Attempts have been made to fill the spaces between the vertical studs normally formed by 2×2's, 2×4's or like wooden beams with insulation material in the form of loose rock wool, fiberglass batts or strips, and the like. Where attempts have been made to employ multiple layers of thermal insulation between the inner and outer walls of the wall assemblies or units, the nature of the walls has been characterized by the appearance of cold spots or localized areas of low thermal impedance.

It is therefore an object of the present invention to provide an improved wall assembly which may be readily and easily fixed in end-to-end fashion to another wall assembly to form a right angle corner joint which is free of air penetration and which is characterized by wall assemblies which each, in itself reduces the effective heat loss at the seams between the strips of thermal insulation material filling the interior cavities of the wall assemblies.

SUMMARY OF THE INVENTION

The modular home double layer, insulated wall corner construction of the present invention is comprised of first and second end joined wall assemblies with each wall assembly including inner and outer edge abutting frames. The outer wall frame comprises horizontally spaced vertical studs, a lower base beam horizontally underlying said studs and fixed thereto, and an upper cross beam horizontally spanning the upper ends of said vertical studs and fixed thereto and forming with said studs and said base beam a series of parallel vertical cavities. Parallel, vertical strips of thermal insulation material positioned within said cavities have at least the ends of said strips fixed respectively to the cross beam and the base beam. The inner wall frame comprises vertical end studs at respective ends longitudinally overlapping and fixed to the end studs of said inner frame. Vertically spaced horizontal cross beams span between said vertical end studs of said inner wall frame, cross the horizontally spaced vertical outer wall studs therebetween, forming horizontal cavities therewith. A plurality of horizontal strips of thermal insulation material fill respective horizontal cavities and have at least the ends thereof, fixed respectively to the end studs of said inner wall frame such that the seams between the adjacent strips of thermal insulation material of the inner and outer wall frames intersect each other to substantially eliminate cold spots within each wall assembly. Further, the outer frame studs and inner frame cross beams form wood to wood contact and heat transfer, limited to a small area of the total wall. The frame end studs of one wall assembly are longitudinally offset relative to the end studs of the other frame to form a first step. The end studs of one frame of the end abutting the other wall assembly includes at least one portion horizontally offset relative to the end stud of the other frame to form a second step. The ends of respective wall assemblies are in abutment at right angles such that the respective steps are internested. Means fix the end studs of respective assemblies together. An air infiltration barrier strip is interposed between abutting steps to form an effective water tight corner joint therebetween.

Preferably, the outer frame of one wall assembly has wider end studs which overlap the exterior surface of the inner frame end studs. With respect to the second frame assembly, the outer frame end studs are provided with end beams on their exterior surfaces spaced from the interior edge of the wall assembly a distance generally equal to the width of the inner wall end stud, and form a step to receive the end studs of said one wall assembly.

Vertically spaced lag screws or bolts extend through the end beams of said second frame assembly and penetrate at least into the outer frame end studs of said first wall assembly to effectively couple the abutting ends of the wall assemblies together. Preferably, the outer walls of the wall assemblies extend beyond the end studs at either end thereof and abut each other at each corner joint to form a cavity at the corner. Strips of thermal insulation material extend vertically at right angles along the inner surface of the outer walls within the corner cavity in abutment with the end studs of respective wall assemblies to limit heat loss through the end joint formed thereby.

An L-shaped corner molding covers or overlies the vertical joint between the abutting edges of the outer wall to further insure a water tight joint between abutting wall assemblies.

DESCRIPTION OF THE PREFERRED EMBODIMENT

Figure 1:
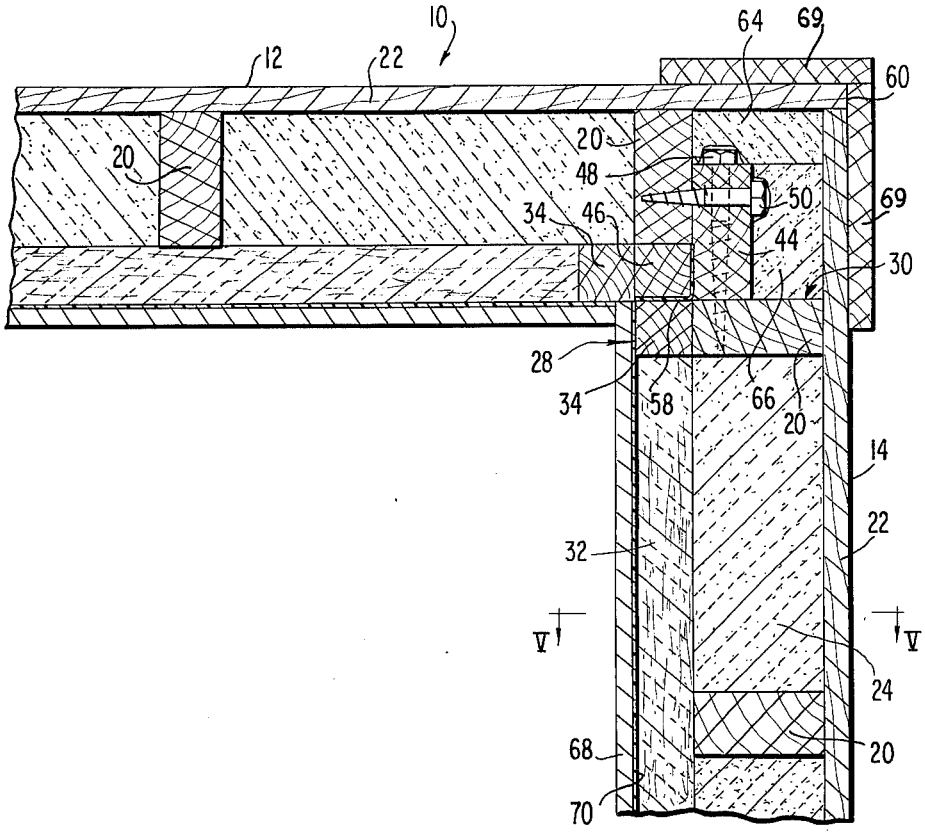
FIG. 1 is a horizontal sectional view of a modular home wall construction corner joint forming one embodiment of the present invention.

Referring to FIG. 1, the horizontal sectional view of one embodiment of the wall construction corner joint of the present invention is indicated generally at 10 and comprises two end abutting wall assemblies as at 12 and 14, respectively, the wall assemblies abutting each other at right angles to form a vertical corner joint for a rectangular building. The present invention has particular application to the modular home industry and as such the wall assemblies 12 and 14, which are quite similar in construction and involve the same essential elements, are prefabricated and preferably joined together at the factory to form a complete modular building or as is conventional, for shipping purposes one section of a two section building split along a horizontal center line. That is, a building section is of half the building width and the two half width sections are joined together at the on-site location subsequent to transport by trailer over the nation's highways.

The nature and steps in the construction of the double thickness thermal insulation wall assembly may be seen by further reference to FIGS. 2–5 inclusive. The only distinction between wall assembly 12 and wall assembly 14 comprises the arrangement of the end studs and their attachment to form a nested, stepped joint facilitating the joining of the two wall assemblies at their ends with appropriate air infiltration barrier and thermal insulation features.

Figure 2:
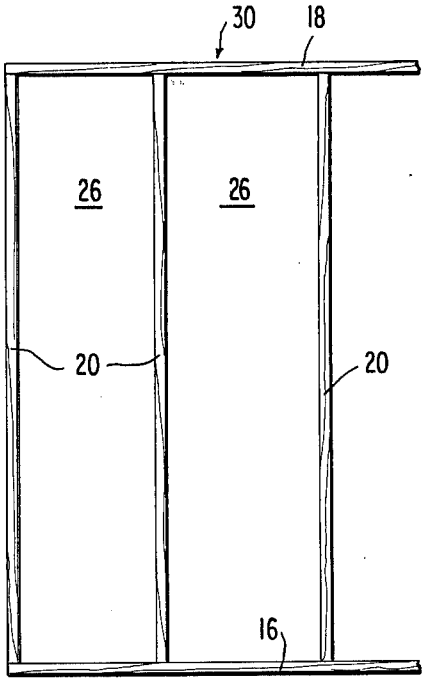
FIG. 2 is a vertical elevational view of an exterior wall frame forming a portion of one wall assembly of the corner joint of FIG. 1.
Figure 3:
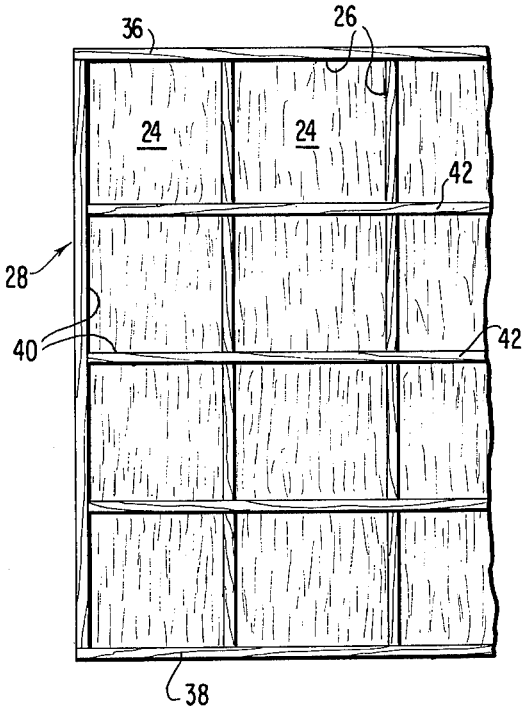
FIG. 3 is a vertical elevational view of a portion of the wall assembly of FIG. 2 with vertical strips of insulation material in place.

In this respect, FIGS. 2–5 inclusive relate to the construction of wall assembly 14. Wall assembly 14, as an example, comprises an inner wall frame 28 and an outer wall frame 30. FIG. 2 shows the outer wall frame 30 which is preferably fabricated and provided with thermal insulation prior to the formation and attachment of the inner frame thereto, in this case in direct abutment therewith. The outer frame comprises a lower base beam 16 which extends horizontally with and parallel to an upper cross beam 18, the beams 16 and 18 being separated by a plurality of laterally spaced vertical studs 20. Base beam 16, cross beam 18 and the studs 20 are all preferably formed of 2×4's. Preferably, the outer frame 30 is formed by laying beams 16, 18 and the studs 20 on a horizontal surface such as a building floor and nailing the same together or otherwise affixing the studs to the various beams. An outer wall 22 formed of plywood or the like may underlie and be fixed to the outer frame 30 prior to the placement of a layer of insulation within vertical cavities 26 formed between the various vertical studs 20, 20', etc. Vertical strips of primary thermal insulation material such as a 3½ inch fiberglass batt strip as at 24 having a length on the order of that of the studs 20 or the distance between the base beam 16 and the cross beam 18, are positioned within the vertical cavities 26 between the studs 20. The upper and lower edges of the strips 24 may be directly affixed to the base beam 16 and cross beam 18 respectively, by nails, staples or the like. The width of the insulation strips 24 may be in excess of the width of the cavities 26 receiving the same such that the vertical side edges of the insulation strips 24 overlap and, if desirable, the vertical edges of strips 24 may be fixed to the vertical studs 20 such that the seams between adjacent insulation strips 24, coincide with the stud beams 20.

Alternatively, depending upon the thickness and the nature of the strips 24 of the insulation material, the vertical edges of adjacent strips may be affixed to opposite sides of the same beam 20.

Figure 4:
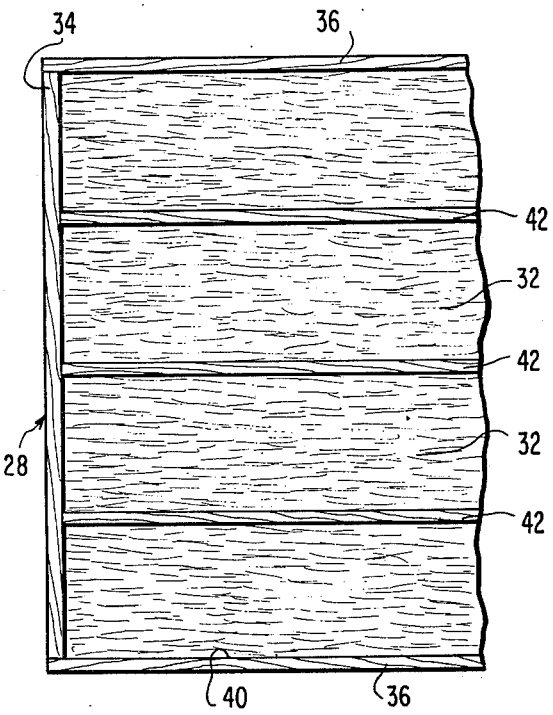
FIG. 4 is a similar vertical elevational view to that of FIG. 3 with horizontal strips of thermal insulation material in place.
Figure 5:
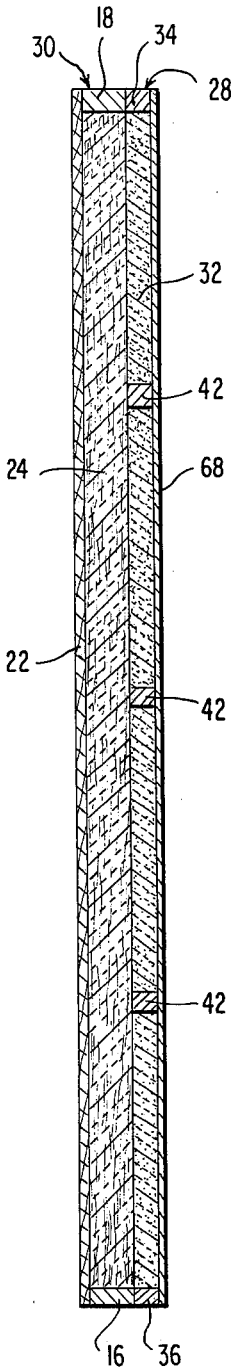
FIG. 5 is a partial vertical section of a portion of the corner joint construction of FIG. 1 taken about line V—V.

Subsequent to the placement of the insulation strips 24 within cavities 26, the inner frame indicated generally at 28, may be independently formed and nailed thereto or created by affixing beams directly to the outer wall frame 30 prior to the placement of the horizontal strips 32 of thermal insulation material within horizontal cavities formed therein, FIG. 4.

Referring to FIG. 4, the inner frame 28 comprises a pair of vertical end beams or studs 34 nailed at their respective ends to an upper cross beam 36 and a lower base beam 38, the assembly being further completed by means of a plurality of vertically spaced, horizontal cross beams 42 which form horizontal cavities 40 within the outer frame 30. A secondary layer of thermal insulation is installed in the form of the horizontal strips 32 of insulation material similar to strips 24, but 2 inches in thickness within the cavities 40 by appropriately fixing the strips thereto such as by stapling the ends of the thermal insulation strips 32 to respective vertical end studs 34 of the inner frame 28. Again, depending upon the nature of the thermal insulation material, either the horizontal edges in this case of the strips 32 are caused to overlap and are affixed to the horizontal cross members 42, or the horizontal edges of adjacent thermal insulation material strips abut and may be fixed to the opposite sides of a cross member 42. The base beam 38, the upper cross beam 36, and the intermediate cross beams 42 securely locate the insulation strips within the inner frame 28. It is noted that the seams (or edges, where the strips 32 do not edge overlap) are at right angles to the seams (or edges) of thermal insulation strips 24 such that the cold spots or low thermal impedance areas are limited to the intersection points of the edges of the respective thermal insulation strips 24 and 32 to minimize heat loss through the wall assembly. Further wall to wall wood contact is made only at crossing points of the vertical studs and the horizontal cross beams of respective frames 28 and 30.

In one form, after the manufacture of each wall assembly, the walls are end-to-end joined to form appropriate corner joints as seen in FIG. 1 prior to the covering of the outer wall frames with outer walls. The outer walls 22 in each case preferably comprise paneling such as plywood or the like, and under certain circumstances this paneling may appropriately be covered by tar paper and wall siding as desired. Such finishing technique is not shown in the illustrated embodiment of the invention.

The nature and make-up of the improved double layer insulated wall assemblies facilitates the improved corner joint formed between abutting ends of respective wall assemblies such as assemblies 12 and 14 of FIG. 1. As may be seen in FIG. 1, the end studs 20 of the outer wall frame 30 which preferably take the form of a wooden 2×4 beam and have mounted thereto by nailing or the like an end beam 44, joined to its outer end face to create a step between inner wall frame end stud 34 and end beam 44.

Wall assembly 12 is also provided with a 2×4 end stud 20 for the outer frame 30 of that wall assembly and the inner frame end stud 34 in the case abuts the end of a second 2×2 stud 46, which in turn abuts the side of stud 34.

In order to effect a connection between the ends of the abutting wall assemblies 12 and 14, end beam 44 of wall assembly 14 is fixed to the side of end stud 20 of wall assembly 12 by lag screws 48. A second series of lag screws 50 maintain end beam 44 in right angle abutment with end stud 20 of wall assembly 12 such that the wall assemblies 12 and 14 are suitably screwed together. Appropriately the screws are spaced no more than approximately 30 inches apart to insure a rigid coupling between the ends of respective wall assemblies. Alternatively, bolts and nuts may be employed in lieu of the lag screws. The lag screws do not pass completely through the end studs of the wall assemblies, and, of course, no access is needed in that embodiment of the invention as would be required to effect the tightening of a nut on a bolt during the assembly alternately described. An air infiltration barrier in the form of a narrow strip of foam plastic as at 58 is interposed between the nested ends of the wall assemblies to prevent the passage of water into the interior of the building formed thereby.

After the screwing of the wall assemblies 12 and 14 together, the outer walls 22 may be suitably affixed to the wall assemblies, if not already applied, by nailing the same to the vertical studs 34, it is noted that the ends of the outer walls 22 extend beyond the end studs 20 and abut each other at 60, thus defining a cavity 62 between the inner surfaces of walls 22 and the ends of respective frames of the respective wall assemblies 12 and 14. Appropriately, vertical strips 64 and 66 of thermal insulation material are positioned within the cavity 62, affixed at their ends and/or sides to the elements forming the wall assemblies with which they abut prior to placement of the outer walls 22 in place. For decoration, and to further effect a water tight seal at the corners, wooden strips 69 are nailed in edge overlapping fashion, the strips extending along respective outer walls 22 of assemblies 12 and 14 to form a corner molding of conventional construction. The outer walls 22 may be formed of a paneling commercially available under the trade name Texture 1-11, and the thermal insulation strips are preferably formed of paperbacked fiberglass or rock wool under the trade name K Superthick. The inner walls 68 may be formed of wall board or Gypsum board with an integral vapor barrier 70 on the non-exposed face thereof.

While the invention has been particularly shown and described with reference to a preferred embodiment thereof, it will be understood by those skilled in the art that various changes in form and details may be made therein without departing from the spirit and scope of the invention.

What is claimed is:

1. An improved modular home wall construction corner joint, said corner joint being formed of first and second, end joined wall assemblies, each wall assembly comprising:

inner and outer walls, edge abutting inner and outer wall frames, said outer wall frame comprising:

horizontally spaced, vertical studs, a lower horizontal base beam underlying the lower ends of said studs and being fixed thereto, an upper cross beam spanning the upper ends of said vertical studs, being fixed thereto and forming with said vertical studs and said base beam a series of parallel vertical cavities, vertical strips of thermal insulation material positioned within said vertical cavities and having at least the ends thereof fixed to said cross beam and said base beam, said inner wall frame overlying and being fixed to said inner wall frame and comprising vertical studs at respective ends of said inner wall frame and vertically spaced, horizontal cross beams spanning between said vertical end studs and lying across and in contact with said vertical studs of said outer wall frame and forming horizontal cavities therebetween, horizontal strips of thermal insulation material positioned within said horizontal cavities and having their ends respectively fixed to respective end studs of said outer frame such that the edges of said strips of said vertical and horizontal thermal insulation material strips intersect each other to substantially eliminate cold spots within the walls of said wall assemblies, limited to crossover contact of said cross beams of said inner wall frame and said vertical studs of said outer wall frame, the end studs of at least one wall frame of each wall assembly being longitudinally offset relative to the end studs of the other wall frame to form an interfitting step for receiving the ends of an abutting wall assembly, means for nesting the end studs of respective wall assemblies together at right angles to each other at said step, an air infiltration barrier strip interposed between the abutting end studs of respective assemblies at said step to form an effective water tight corner joint, said outer walls extending beyond the end studs of respective wall assemblies and abutting each other to form a vertical corner cavity with said end studs of respective wall assemblies, and thermal insulation material strips overlying respective faces of said end studs within said cavity to reduce heat loss through said corner joint.

2. The wall construction corner joint as claimed in claim 1, wherein the outer wall frame of said first wall assembly has its end studs extended by means of an end beam to form one wall assembly stepped end, and the end studs of the outer and inner wall frames of said second wall assembly both abut said end beam.

3. The wall construction corner joint as claimed in claim 2, wherein said means for fixing the end studs of respective wall assemblies together comprise: lag screws fixing said end beam to respective outer wall frame studs of both wall assemblies.

* * * * *